US007621287B2

(12) United States Patent
Rosenbauer et al.

(10) Patent No.: US 7,621,287 B2
(45) **Date of Patent: *Nov. 24, 2009**

(54) ARRANGEMENT FOR IMPROVING THE DRYING PERFORMANCE OF AN AUTOMATIC DISHWASHER

(75) Inventors: Michael Rosenbauer, Reimlingen (DE); Heinz Heissler, Dillingen (DE); Ulrich Deiss, Sontheim (DE); Gerhard Fetzer, Gundelfingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1178 days.

This patent is subject to a terminal disclaimer.

(21) Appl. No.: 10/437,550

(22) Filed: May 13, 2003

(65) Prior Publication Data

US 2004/0031508 A1 Feb. 19, 2004

Related U.S. Application Data

(63) Continuation of application No. PCT/EP01/11902, filed on Oct. 15, 2001.

(30) Foreign Application Priority Data

Nov. 15, 2000 (DE) ..... 100 56 489

(51) Int. Cl.
*B08B 3/02* (2006.01)

(52) U.S. Cl. ..... 134/135; 134/201; 211/41.9

(58) Field of Classification Search ..... 134/135, 134/210, 201; 211/41.9
See application file for complete search history.

(56) References Cited

U.S. PATENT DOCUMENTS 2,046,207 A * 6/1936 Parsons ..... 220/488
2,666,549 A * 1/1954 Horne, Jr. ..... 220/487
2,712,286 A * 7/1955 Kiefer ..... 417/559
3,025,864 A * 3/1962 Ensign ..... 134/115 G (Continued)

FOREIGN PATENT DOCUMENTS

CA 2176544 * 11/1977

(Continued)

OTHER PUBLICATIONS

European Patent Office 0 488 093 Jun. 1992.*

(Continued)

*Primary Examiner*—Frankie L Stinson
(74) *Attorney, Agent, or Firm*—James E. Howard; Andre Pallaples

(57) ABSTRACT

An arrangement for improving a drying performance of an automatic dishwasher including at least one dish basket is provided. The automatic dishwasher is adapted to be operated with cleaning programs including at least one rinsing subprogram and one drying subprogram. An insert for the dish basket adapted to be loaded with at least one of a plurality of silverware pieces and small dishes or other objects includes structure for providing autonomous run-off of dish washing liquid in contact with liquid problem retention areas of the insert. The structure includes a plurality of openings for the penetration of a dish washing liquid, the openings being limited by a plurality of ridges crossing in-plane at a plurality of crossing points forming the openings, and the ridges are formed in a sloped structure having a substantially rhomb shaped cross-section.

18 Claims, 2 Drawing Sheets

U.S. PATENT DOCUMENTS

Figure 1:
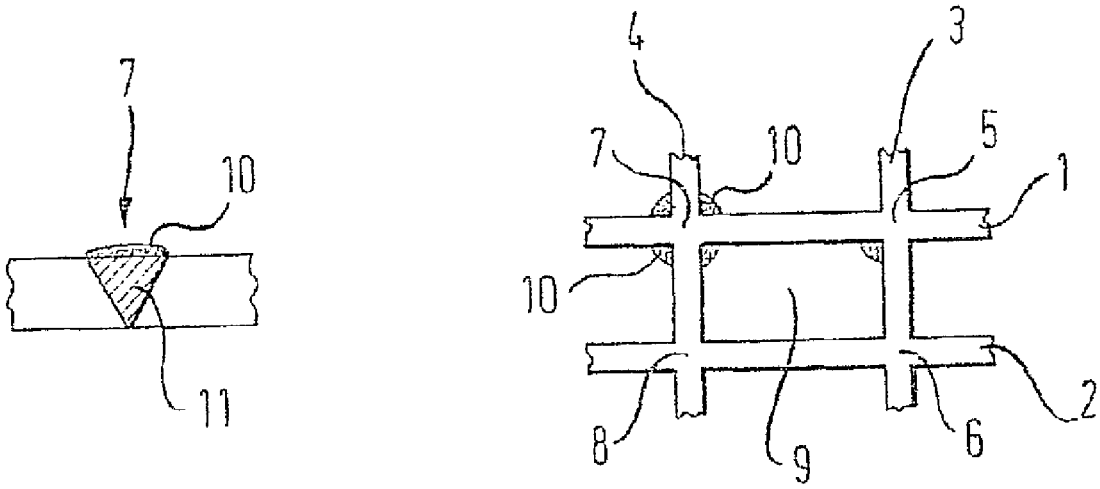

| | | | | | |
|---|---|---|---|---|---|
| 3,182,854 | A | * | 5/1965 | Geller | 220/676 |
| 3,294,273 | A | * | 12/1966 | Ettlinger | 220/23.83 |
| 4,157,145 | A | * | 6/1979 | Jordan | 220/487 |
| 4,192,432 | A | * | 3/1980 | Jordan | 220/676 |
| 4,339,051 | A | * | 7/1982 | Crawford | 220/607 |
| 4,834,125 | A | * | 5/1989 | Insalaco | 134/201 |
| 5,086,544 | A | * | 2/1992 | Huttemann et al. | 211/41.8 |
| 5,287,984 | A | * | 2/1994 | Michael | 220/812 |
| 5,431,294 | A | * | 7/1995 | Stottmann et al. | 220/23.4 |
| 5,881,906 | A | * | 3/1999 | Rogers et al. | |
| 6,945,421 | B2 | * | 9/2005 | Phifer | |

FOREIGN PATENT DOCUMENTS

| | | | |
|---|---|---|---|
| DE | 1503780 | | 6/1969 |
| DE | 7605749 | | 11/1976 |
| DE | 27 55 892 | * | 6/1979 |
| DE | 34 47 302 | * | 6/1986 |
| DE | 36 41 020 | * | 2/1988 |
| DE | 3641020 | | 4/1988 |
| DE | 4414347 | | 10/1995 |
| DE | 19540610 | | 5/1997 |
| DE | 19540611 | | 5/1997 |
| DE | 19820979 | | 11/1999 |
| EP | 0448531 | | 9/1991 |
| FR | 2 240 708 | * | 3/1975 |
| GB | 2 303 055 | * | 7/1995 |

OTHER PUBLICATIONS

European Patent Office 0 011 569 Nov. 1979.*
European Patent Office 0 385 877 Sep. 1990.*
European Patent Office 0 697 187 Jul. 1995.*

* cited by examiner

ARRANGEMENT FOR IMPROVING THE DRYING PERFORMANCE OF AN AUTOMATIC DISHWASHER

The invention relates to an arrangement for improving the drying performance of an automatic dish washer provided with at least one dish basket according to the preamble of claim 1.

From the German publication DE 44 14 347 a method for operating an automatic dishwasher is known, that can be operated with cleaning programs comprising at least one subprogram for drying and one subprogram for rinsing.

From the German patent DE 36 41 020 an arrangement for cleaning and drying silverware pieces and small dishes in an automatic dish washer has been known allowing an improvement of the drying performance in reference to prior arrangements. Here, at least one dish basket is provided with a silverware basket, which can be inserted therein, having openings provided both in the floor of the silverware basket and the walls of the silverware basket for the penetration of dish washing liquid. Additionally, a tray, having additional openings for silverware pieces that can be hung and/or fasteners and/or retainers for small dishes, may be inserted into the basket floor of the dish basket or may be positioned onto the silverware basket in a lid-like fashion. The openings thus arranged in the side walls, the floor, and the cover of the silverware basket and/or the tray are each limited by straight ridges crossing in plane at a right angle.

From the German utility patent DE 76 05 749 an arrangement is known, in which the ridges limiting the openings of the floor of the silverware basket are provided with ridge sections extending at a slope. These ridge sections are originating in the level of the silverware basket and unite outside of this level. The advantage of this silverware basket, which is difficult to produce, though, is an improved drop runoff off from the floor of the silverware basket only in reference to horizontally extending ridges.

From the German publication DE 198 20 979 an arrangement for automatic dish washers is known, in which the ridges pertinent to a silverware tray and coupled with one another are provided with higher and lower points in the shape of a pyramid, in order to improve the drying performance of the silverware tray. In the German publications 195 40 610 and 195 40 611, also called etageres, trays for dish basket in an automatic dish washer are described, which may respectively be mounted firmly or movably to the dish basket and/or arranged loosely as inserts for the cleaning and drying of silverware pieces and/or small dishes.

All of the arrangements known are disadvantageous because frequently dish washing liquid remains, e.g. on a horizontal plane, which cannot run-off autonomously and requires drying. Therefore, contacting silverware pieces are usually still wet at the shaft, even after the drying phase of a cleaning program. Furthermore, a silverware basket and/or other devices disadvantageously wet increasingly in the corners of the individual openings or perforations embodied in a rectangular shape, which the silverware pieces usually contact, i.e., a multitude of "contact points" exist for the dish washing liquid aggravating the drying process and/or extending the drying phase and leading to the formation of drying spots on the silverware pieces.

The invention is based on the object of providing an arrangement allowing a further improved drying achievement in reference to solutions known.

This object is attained by the characteristics of claim 1. Further embodiments of the invention are mentioned in the dependent claims.

Based on an arrangement of the type mentioned at the outset, means are formed at an insert, which can be loaded with silverware pieces and/or small dishes for drops of dish washing liquid to run-off, said means cause the run-off of drops of dish washing liquid in the problem areas of the insert. These means lead to the drops of liquid to autonomously running off and, thus, inhibit the development of undesired drying spots on the silverware pieces and/or the small dishes. This results in an even further improved drying performance and a shortening of the drying phase in reference to arrangements known.

According to a particularly beneficial further embodiment of the invention the insert is provided with several openings for the penetration of dish washing liquid, which openings are limited by ridges crossing in-plane at crossing points embodied in a sloped manner such that they are respectively provided with a rhomb shaped cross section. The rhomb shaped profile of the ridges embodied in a sloped manner creates a type of double pyramid at the crossing points. Due to the rhomb shaped profile and the double-pyramid shaped profile developing at the crossing points, the dish washing liquid can, particularly in the critical points, autonomously run-off downwards over the sloped planes present on all sides of the rhomb and/or the double pyramid. This prevents the residue of dish washing liquid on horizontal planes and the numerous contact points, particularly at the crossing points. Overall, an insert designed in such fashion results in an essentially improved drying performance for the objects placed in the insert, primarily silverware pieces and/or small dishes, in reference to conventional solutions. The disadvantageously increased wetting of numerous contact points in conventional inserts, particularly in the corners of the individual openings or apertures, is also reduced by the sloped ridges embodied rhomb shaped in the cross section, which improve the drying process and shorten the drying phase and prevent the development of drying spots on the silverware pieces.

According to another embodiment of the invention the openings of the insert are each embodied rounded by radiuses in the area of the crossing points. Thus allowing the dish washing liquid to run-off even better through the openings rounded in the "corners", which accelerates the drying process during the drying phase in an advantageous manner, particularly at the silverware pieces and/or small dishes usually contacting the "corners" of the openings, i.e., the problem areas.

According to an alternative, yet equally beneficial further embodiment of the invention, the insert, constructed with insert compartments each separated from one another by dividing walls, is provided with at least two insert compartments having compartment floors arranged in different heights for loading the various silverware pieces and/or small dishes. Overall, an insert designed in this manner leads to an essentially improved drying result for the silverware pieces and/or the small dishes placed in the insert in reference to conventional solutions. The silverware pieces and/or the small dishes may be loaded depending on their respective length/size/shape into the insert compartment having the compartment floor of the corresponding height so that they stand on the compartment floor and are no longer subject to be hung. The autonomous run-off of drops of dish washing liquid, which otherwise lead to the undesired drying spots, is supported by this simple, yet effective measure. The hanging in a cover, particularly of small parts, which causes the run off problems for the drops mentioned, is omitted by the insert compartments having variously high compartment floors.

According to another embodiment of the invention, the heights of the compartment floors are adjustable to the length and/or size of the silverware pieces and/or the small dishes. Thus creating, depending on the need, sections partially adjusted in their usable height as variable insert compartments, which may be combined to a variably designed insert for most different silverware pieces and/or small dishes.

According to an advantageous variant the insert compartments form a silverware basket provided with a floor of a silverware basket having various useful heights by the compartment floors.

The object of the invention is explained in greater detail using an exemplary embodiment shown in the drawing. In detail it shows FIG. 1 an initial variant of an arrangement with a section of an insert designed in a conventional fashion with the cross section of the ridges at the crossing points, FIG. 2 the section of the insert according to FIG. 1 with the cross-section of the ridges for improving the drying performance of the arrangement according to the object of the invention and FIG. 3 a second variant of the invention with a very simplified side view of an insert having several insert compartments for improving the drying performance according to the object of the invention.

Figure 2:
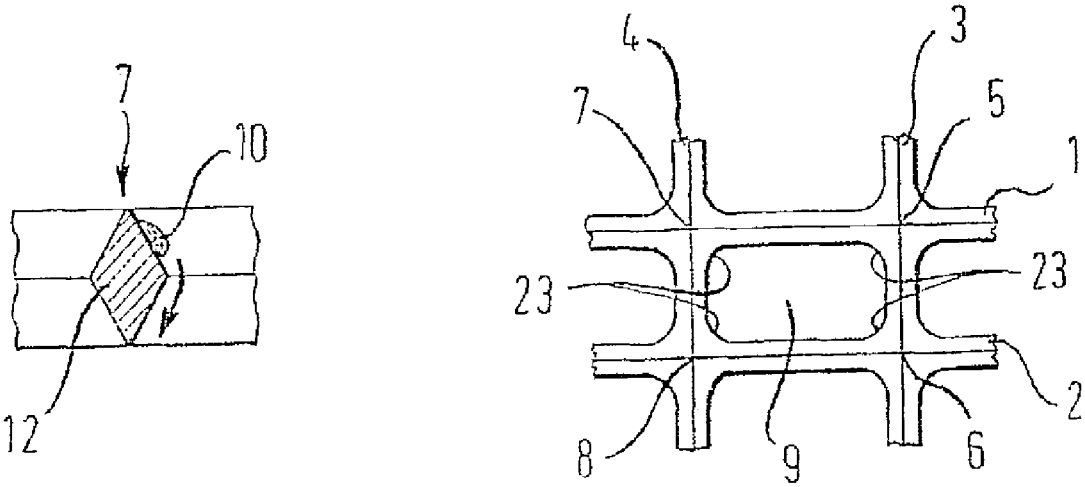

FIG. 1 and FIG. 2 show only one section of the arrangement for improving the drying performance, sufficient for demonstrating the principle of the invention, though. This arrangement includes an insert, for example loosely arranged or firmly or movably mounted in a dish basket serving as a silverware basket to be loaded with silverware pieces and/or small dishes in an automatic dish washer. The elementary structure of a silverware basket having sidewalls, a floor, and/or a cover is equivalent to the insert described in the patent DE 36 41 020. The use of the insert, having means according to the object of the invention, as a tray, an étagère, is also possible, which can be loaded with silverware pieces and/or small dishes.

The section of the insert according to prior art shown in FIG. 1 comprises two longitudinally extending ridges 1 and 2 and two laterally extending ridges 3 and 4, which may form both the side walls of the insert as well as the floor of the silverware basket and/or the cover of the silverware basket. Here, the ridges 1 and 2 cross the ridges 3 and 4 in four crossing points 5, 6, 7, and 8 and, thus, limit an opening 9, which forms an opening for the penetration of dish washing liquid 10.

The ridges 1 through 4 each crossing in the crossing points 5 through 8, of which FIG. 1 shows a crossing point 7 in the view of the cross section and/or the profile, as an example, are embodied preferably sloped downward in the shape of a cone 11, in order to improve the drying performance for the silverware pieces and/or the small dishes in reference to the inserts known having ridges extending straight. However, FIG. 1 shows existing problem areas, where the dish washing liquid 10 remains in spite of the sloped ridges and cannot run-off autonomously. These are, primarily, the horizontal planes of the insert and the corners of the individual openings 9, in which the silverware basket is increasingly wet, and which the pieces contact.

Therefore, according to FIG. 2, the ridges 1 through 4 are embodied in a sloped manner such that they are each provided with a rhomb shaped cross-section, provided with a profile of the type of a double pyramid 12 in the crossing points 5 through 8, of which again only the crossing point 7 is shown as an example in the view of the cross-section and/or the profile. This results in an optimization of the drying results and the duration of the drying phase, by way of the dish washing liquid 10 being pulled downward over all sloped planes of the rhomb, indicated by the arrow, i.e., being enabled to run-off autonomously. The improved drying process is additionally enhanced by the opening 9, each embodied in a rounded manner by means of radiuses 13 in the crossing points 5 through 8, which is shown representing the design of the other openings of the silverware basket. Due to the downward run-off, the contact points in the "corners" wet by dish washing liquid are no longer present, the silverware pieces and/or the small dishes contacting the silverware basket dry more quickly. The rapid and autonomous drainage of the dish washing liquid, due to the sloped ridges provided with a rhomb shape at the cross-section, and the reduction of the contact points, due to the rounded openings, not only optimizes the drying performance, but advantageously improves the cleaning performance of a rinsing and drying program of an automatic dish washer as well and prevents the development of drying spots on the silverware pieces.

Figure 3:
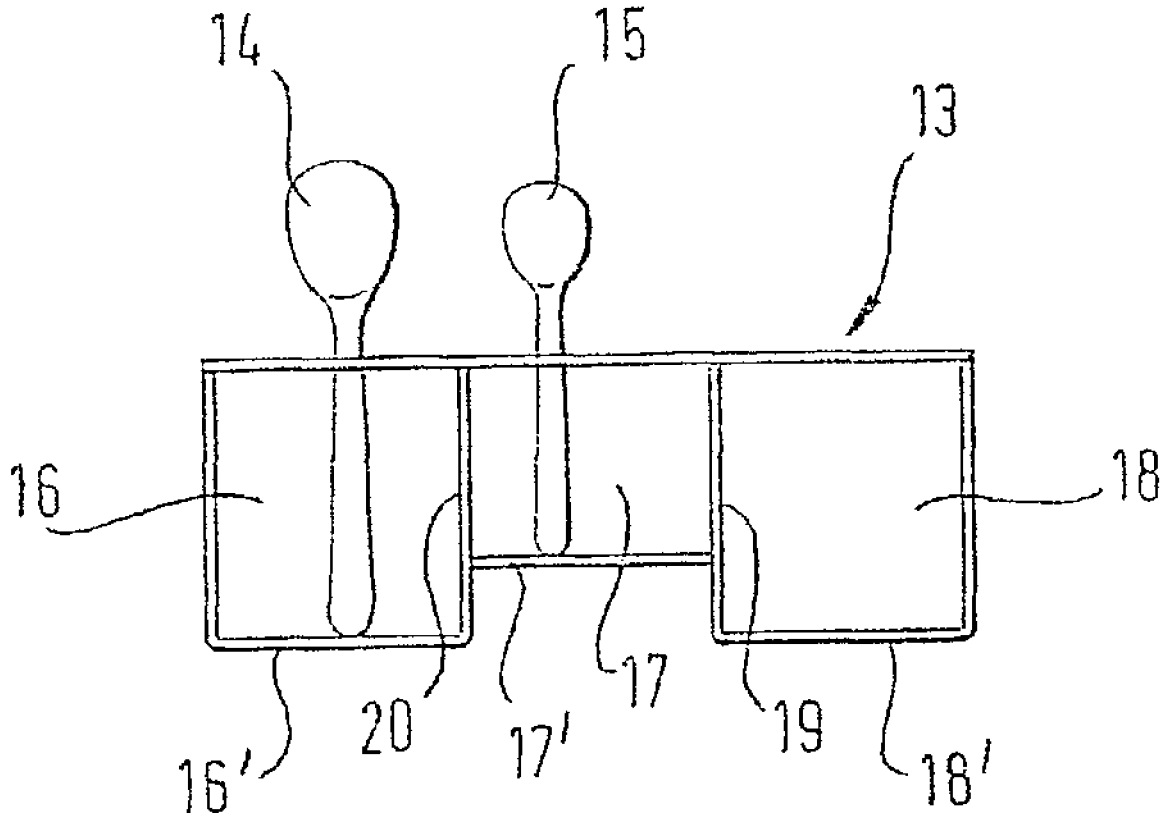

FIG. 3 shows another variant of the arrangement having means for improving the drying performance. The arrangement includes, as shown in FIG. 1 and FIG. 2, an insert, which in the exemplary embodiment is embodied as a silverware basket 13 to be loaded with silverware pieces and/or small dishes, in the example selected with spoons 14 and 15 having various length and/or size, and is loosely arranged in the dish basket of an automatic dish washer or firmly or movably mounted thereto. The elementary structure of such a silverware basket is equivalent to the insert described in the patent DE 36 41 020 having side walls, a floor, and/or a cover.

In the example selected, the silverware basket 13 comprises a total of 3 insert compartments 16, 17, and 18 separated from one another by two vertically extending dividing walls 19 and 20. In principle, the silverware basket may also be provided with a different number of compartments, at least two, though. According to the invention, at least two of the compartments, here, for example, the compartments 16 and 17 or 17 and 18, are provided with compartment floors 16' and 17' or 17' and 18' arranged at various heights. The long spoon 14, as shown, is positioned in the insert compartment 16 with the corresponding compartment floor 16' and the longer usable height, so that it securely stands on the compartment floor 16'. A loading of the spoon 14 into the insert compartment 18 is possible as well, with the compartment floor 18' being on the same height as the one of the insert compartment 16'. In contrast hereto, the insert compartment 17 positioned in the center serves for accepting and/or for being loaded with the short spoon 15, in order for this one standing securely also on the corresponding compartment floor 17'.

Preferably, the three insert compartments 16 through 18 are provided with compartment floors 16' through 18' positioned at various heights, in order to create for the silverware basket 13 different usable heights, partially adjustable in the individual sections. Overall, the compartment floors 16' through 18' of the insert compartments 16 through 18, individually different in their height, create a floor of a silverware basket having various usable height. Therefore, a raising and a lowering of the floor of the silverware basket is possible in selected sections, in order to optimize the drying result when loading the insert, particularly with silverware pieces and/or with small dishes of various length, size, shape, etc. The improved drying process is achieved by the variable design of the insert according to the invention, enhancing the run-off of the drops of the dish washing liquid by the embodiment of the floor of the silverware basket being provided with various usable heights. The silverware pieces and/or small dishes standing on the compartment floors 16' through 18' dry quicker. The rapid and autonomous drainage of dish washing liquid on the respective insert compartments 16 through 18 with the corresponding compartment floors 16' through 18' having suitable heights not only optimizes the drying performance but also improves beneficially the cleaning performance of the rinsing and drying program of an automatic dish washer.

The above-described means according to the invention lead to the drops of the liquid running-off autonomously and by themselves and, thus, prevent the formation of undesired drying spots on the silverware pieces and/or the small dishes. This results in an improved drying performance and a shortened drying phase in reference to arrangements known.

The invention claimed is:

1. An arrangement for improving a drying performance of an automatic dishwasher including at least one dish basket, the automatic dishwasher adapted to be operated with cleaning programs including at least one rinsing subprogram and one drying subprogram, said improved arrangement comprising:

an insert for the dish basket adapted to be loaded with at least one of a plurality of silverware pieces and small dishes or other objects; and said insert including structure for providing autonomous run-off of dish washing liquid in contact with liquid problem retention areas of said insert, said structure includes a plurality of openings for the penetration of a dish washing liquid, said openings are limited by a plurality of ridges crossing in-plane at a plurality of crossing points forming said openings, and said ridges are formed in a sloped structure having a substantially rhomb shaped cross-section.

2. The arrangement according to claim 1, including said rhomb shaped cross-sections of said ridges at said crossing points form a substantially double pyramid shape.

3. The arrangement according to claim 1, including said crossing points including rounded radiuses forming substantially rounded corners in said openings.

4. The arrangement according to claim 1, including said insert being a silverware basket which is adapted to be loaded with at least one of a plurality of silverware pieces and small dishes or other objects and said plurality of ridges crossing in-plane at a plurality of crossing points forming said openings form at least one of the floor, side walls and lid of said basket.

5. The arrangement according to claim 1, including said plurality of ridges crossing in-plane at a plurality of crossing points forming said openings form a tray which is adapted to be loaded with at least one of a plurality of silverware pieces and small dishes or other objects.

6. The arrangement according to claim 1, including a plurality of insert compartments separated from one another by dividing walls; and at least two of said insert compartments having compartment floors of different heights from one another for loading at least some of different length silverware pieces and small dishes or other items.

7. The arrangement according to claim 6, including said compartment floor heights adjusted to accommodate said different length silverware pieces and small dishes or other items.

8. The arrangement according to claim 6, including said plurality of insert compartments forming a silverware basket and said silverware basket compartment floor heights adjusted to accommodate said different length silverware pieces and small dishes or other items.

9. The arrangement according to claim 8, including said silverware basket mounted fixedly or removably to the dish basket.

10. The arrangement according to claim 8, including said silverware basket mounted loosely to the dish basket.

11. The arrangement according to claim 1, including said insert structure mounted fixedly or removably to the dish basket.

12. The arrangement according to claim 1, including said insert structure mounted loosely to the dish basket.

13. The arrangement according to claim 1, including a plurality of insert compartments separated from one another by dividing walls; and at least two of said insert compartments having compartment floors of different heights from one another for loading at least some of different length silverware pieces and small dishes or other items.

14. The arrangement according to claim 13, including said compartment floor heights adjusted to accommodate said different length silverware pieces and small dishes or other items.

15. The arrangement according to claim 13, including said plurality of insert compartments forming a silverware basket and said silverware basket compartment floor heights adjusted to accommodate said different length silverware pieces and small dishes or other items.

16. The arrangement according to claim 15, including said silverware basket mounted fixedly or removably to the dish basket.

17. The arrangement according to claim 15, including said silverware basket mounted loosely to the dish basket.

18. An arrangement for improving a drying performance of an automatic dishwasher including at least one dish basket, the automatic dishwasher adapted to be operated with cleaning programs including at least one rinsing subprogram and one drying subprogram, said improved arrangement comprising:

an insert for the dish basket adapted to be loaded with at least one of a plurality of silverware pieces and small dishes or other objects, said insert including a structure comprising a plurality of openings defined by a plurality of ridges crossing in-plane at a plurality of crossing points forming said openings for providing autonomous run-off of dish washing liquid in contact with liquid problem retention areas of said insert and said insert being mountable to the dish basket by a selected one of a fixed mounting arrangement, a removable mounting arrangement, and a non-removable loose mounting arrangement.

* * * * *

UNITED STATES PATENT AND TRADEMARK OFFICE

CERTIFICATE OF CORRECTION

PATENT NO. : 7,621,287 B2
APPLICATION NO. : 10/437550
DATED : November 24, 2009
INVENTOR(S) : Rosenbauer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1736 days.

Signed and Sealed this

Twenty-sixth Day of October, 2010

David J. Kappos

David J. Kappos
*Director of the United States Patent and Trademark Office*